US005173134A

United States Patent [19]

Chakrabarti et al.

[11] Patent Number: 5,173,134

[45] Date of Patent: Dec. 22, 1992

[54] PROCESSING ALPHA-BETA TITANIUM ALLOYS BY BETA AS WELL AS ALPHA PLUS BETA FORGING

[75] Inventors: Amiya K. Chakrabarti, Monroeville; George W. Kuhlman, Jr., Pepper Pike; Robert Pishko, Murrysville, all of Pa.

[73] Assignee: Aluminum Company of America, Pittsburgh, Pa.

[21] Appl. No.: 626,282

[22] Filed: Dec. 3, 1990

Related U.S. Application Data

[60] Division of Ser. No. 284,090, Dec. 14, 1988, Pat. No. 4,975,125, and a continuation-in-part of Ser. No. 284,090.

[30] Foreign Application Priority Data

Nov. 28, 1990 [EP] European Pat. Off. ..... 90403381.8

[51] Int. Cl.[5] ..... C22F 1/00

[52] U.S. Cl. ..... 148/671; 148/421; 148/670

[58] Field of Search ..... 148/11.5 F, 12.7 B, 148/133, 421

[56] References Cited

U.S. PATENT DOCUMENTS

| | | | |
|---|---|---|---|
| 3,649,374 | 3/1972 | Chalk | 148/12.7 B |
| 3,867,208 | 2/1975 | Grekov et al. | 148/12.7 B |
| 4,168,185 | 9/1979 | Takisawa et al. | 148/12.7 B |
| 4,581,077 | 4/1986 | Sakuyama et al. | 148/12.7 B |
| 4,842,652 | 6/1989 | Smith et al. | 148/20 |
| 4,854,977 | 8/1989 | Alheritiere et al. | 148/12.7 B |

*Primary Examiner*—Upendra Roy
*Attorney, Agent, or Firm*—Daniel A. Sullivan, Jr.

[57] ABSTRACT

High performance titanium alloys useful as impellers and disks for gas turbine engines are provided, together with processes for their preparation.

29 Claims, 2 Drawing Sheets

PROCESSING ALPHA-BETA TITANIUM ALLOYS BY BETA AS WELL AS ALPHA PLUS BETA FORGING

CROSS REFERENCE TO RELATED APPLICATION

This is a division and a continuation-in-part of U.S. patent application Ser. No. 07/284,090, filed Dec. 14, 1988 re Titanium Alpha-Beta Alloy Fabricated Material and Process for Preparation to Amiya K. Chakrabarti et al., now U.S. Pat. No. 4,975,125.

TECHNICAL FIELD

This invention relates to titanium alpha-beta alloys. It also relates to methods of processing these alpha-beta alloys. More precisely the invention relates to titanium alpha-beta alloy fabricated material having improved mechanical properties rendering it more useful, for instance, as rotating components such as impellers and disks for gas turbine engines and the like.

BACKGROUND OF INVENTION

Turbine engine impellers of Ti-6Al-4V and other titanium alloys are currently being used both by gas turbine engine manufacturing companies in the USA and abroad for use at temperatures of up to 300° C. (570° F.).

DISCLOSURE OF INVENTION

This invention is concerned with the provision of titanium alpha-beta alloy fabricated material having improved mechanical properties. Depending on the particular alloy, the fabricated material may be capable of services at temperatures higher than 300° C.

Thus, it has now been discovered that titanium alloys can be prepared, using the process technology of this invention, which are particularly suitable for use as impellers and disks and for other uses involving low cycle fatigue. Significantly improved tensile properties and particularly improved low cycle fatigue properties are obtained, along with modest improvement in fracture toughness and crack growth resistance. Thus, one process variant of the invention gives higher fracture toughness with higher fatigue crack growth resistance and a moderate low cycle fatigue life; while another variant gives improved low cycle fatigue properties and tensile strength with moderate fracture toughness. The alloys are effective at temperatures up to 750° F. (400° C.).

More particularly, it has been discovered that if a Ti-6Al-2Sn-4Zr-6Mo alloy (which can contain minor amounts of oxygen and nitrogen) is formed into a particular microstructure and heat treated at optimum temperatures, improved components can be achieved.

All parts and percentages in this specification and its claims are by weight unless otherwise indicated.

BRIEF DESCRIPTION OF DRAWINGS

The drawings (FIGS. 1A–4C) are photomicrographs of the alloys resulting from the process conditions listed in Table II. Beta phase (matrix) appears dark and alpha phase (particles) light in the photomicrographs.

MODES FOR CARRYING OUT THE INVENTION

The Alloy

Figure 1A:
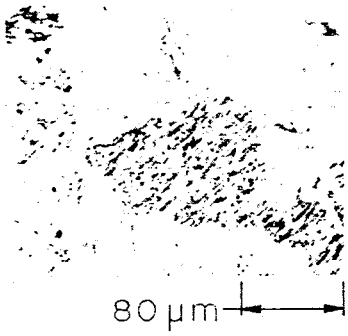
FIGS. 1A, 1B and 1C show microstructure, respectively, at center, mid-radius, and rim, all at mid-height, in a 25.4 cm diameter by 6.35 cm thick pancake forging.

In general, alloys for embodiments of the present invention fall under the category, titanium alpha-beta alloys. Examples of alpha-beta alloys are Ti-6Al-4V, Ti-6Al-6V-2Sn (Cu+Fe), Ti-6Al-2Sn-2Zr-2Mo-2Cr-0.25Si, and Ti-6Al-2Sn-4Zr-2Mo, the last being sometimes termed a "near-alpha" alloy.

The invention will be explained below as it applies to the Ti-6Al-2Sn-4Zr-6Mo alpha-beta alloy, with the understanding that those skilled in the art will be able to analogize application of the principles involved to other titanium alpha-beta alloys.

A titanium alloy Ti-6Al-2Sn-4Zr-6Mo which can be used to obtain the improved properties has the following general composition:

5.50 to 6.50% aluminum,
3.50 to 4.50% zirconium,
1.75 to 2.25% tin,
5.50 to 6.50% molybdenum,
0 to 0.15% iron
0 to 0.15% oxygen
0 to 0.04% carbon,
0 to 0.04% (400 ppm) nitrogen,
0 to 0.0125% (125 ppm) hydrogen,
0 to 0.005% (50 ppm) yttrium,
0 to 0.10% residual elements, each
0 to 0.40% residual elements, total, and remainder titanium.

Processing in General

Products of the invention are achieved via two general routes, namely by

Route 1. $\beta$-fabricating plus $\alpha$-$\beta$ solution heat treatment plus aging, and by Route 2. $\alpha$-$\beta$-fabricating plus $\alpha$-$\beta$ solution heat treatment plus aging.

Route 1, in general, gives higher fracture toughness with higher fatigue crack growth resistance and a moderate low cycle fatigue life; while route 2 gives improved low cycle fatigue properties and tensile strength with moderate fracture toughness.

To quantify these property characteristics for the Ti-6Al-2Sn-4Zr-6Mo alloy, process route 1 can achieve average values as follows: yield strength greater than (>) 150 ksi (kilopounds per square inch) (1034 MPa), ultimate tensile strength > 160 ksi (1102 MPa), elongation > 7%, reduction in area > 15%, fracture toughness $K_{Ic}$ > 60 ksi·in$^{\frac{1}{2}}$ (65.9 MPa·m$^{\frac{1}{2}}$), low cycle fatigue life > 10,000 cycles at a total strain range of 1.0%, and fatigue crack growth rate less than or equal to (≦) about $2\times10^{-6}$ inches per cycle ($5\times10^{-8}$ meters per cycle), and even $\leqq 1\times10^{-6}$ inches per cycle ($2.5\times10^{-8}$ meters per cycle), at a $\Delta K = 10$ ksi·in$^{\frac{1}{2}}$ (11 MPa·m$^{\frac{1}{2}}$). Extrapolating from our results to this point, we believe that by following process route 1 we should be able to exceed these minimums, respectively maximums, by at least another 10% of the values just stated.

Process route 2 can achieve average values as follows: yield strength greater than (>) 150 ksi (kilopounds per square inch) (1034 MPa), ultimate tensile strength > 160 ksi (1102 MPa), elongation > 7%, reduction in area > 15%, fracture toughness $K_{Ic}$ > 45 ksi in$^{\frac{1}{2}}$ (49.4 MPa·m$^{\frac{1}{2}}$), low cycle fatigue life > 15,000 cycles at a total strain range of 1.0%, and fatigue crack growth rate less than or equal to (≦) about $2\times10^{-6}$ inches per cycle ($5\times10^{-8}$ meters per cycle), and even $\leqq 1\times10^{-6}$ inches per cycle ($2.5\times10^{-8}$ meters per cycle), at $\Delta K = 10$ ksi·in$^{\frac{1}{2}}$ (11 MPa·m$^{\frac{1}{2}}$). Extrapolating from our results to this point, we believe that by following process route 2 we should be able to exceed these minimums, respectively maximums, by at least another 10% of the values just stated.

References here and throughout this specification and its claims to the qualifiers "$\beta$" or "beta" and "$\alpha$-$\beta$" or "alpha-beta" with respect to fabricating steps mean "carried out within the temperature range of, respectively, the $\beta$-phase field and the $\alpha$-$\beta$ phase field where the $\alpha$ and $\beta$ phases coexist, both fields being as shown on the phase diagram for the alloy".

For general information on the subject of phase diagrams for titanium alloys such as the Ti-6Al-2Sn-4Zr-6Mo alloy of concern in this invention, refer to the discussion of FIG. 6-53 on page 238 in "Elements of Physical Metallurgy" by Albert G. Guy, Addison-Wesley, Reading, Mass. 1959.

The term "beta-transus" refers to the temperature at the line on the phase diagram separating the $\beta$-phase field from the $\alpha$-$\beta$ region of $\alpha$ and $\beta$ phase coexistence. "$T_\beta$" is another way of referring to the beta-transus temperature. A term such as "$T_\beta - 42°$ C." means "temperature whose value equals ($T_\beta$ minus 42° C.)".

For the Ti-6Al-2Sn-4Zr-6Mo alloy of concern in this invention, $T_\beta$ is around 1750° F. (950° C.). $T_\beta$ may be determined for a given composition by holding a series of specimens for one hour at different temperatures, perhaps spaced by 5 degree intervals, in the vicinity of the suspected value of $T_\beta$, then quenching in water. The microstructures of the specimens are then observed. Those held at temperatures below $T_\beta$ will show the $\alpha$ and $\beta$ phases, whereas those hold above $T_\beta$ will show a transformed $\beta$ structure.

The fabricating mentioned for processing routes 1. and 2. involves plastic deformation of the metal. Forging is one example of a fabricating process. As is well known, forging can involve a progressive approach toward final forged shape, through the use of a plurality of dies, for example preform (or blocker) dies and finish dies. It is of advantage in the present invention to use "hot die" forging, i.e. a die temperature which is e.g. above about 550° C. (1020° F.). An advantage of hot die forging in the present invention is that it avoids formation of a chill zone of different properties than the rest of the metal. However, as shown by Example 5 below, "warm die" forging with a die temperature in the range from about 550° C. down to about 250° C. (480° F.) can also lead to very acceptable properties in the present invention.

In the case of $\beta$-fabrication, i.e. processing route 1., it may be beneficial that the temperature actually fall during fabrication into the range of $\alpha$-$\beta$ coexistence; this is termed "through-transus" $\beta$-fabricating, in that the fabrication process starts out at temperatures in the $\beta$-region and falls during fabrication such that the $\alpha$-$\beta$-region is reached.

It will be noted that times and temperatures of elevated temperature operations, for instance forging temperatures and solution and aging treatments, are qualified herein by the term "about", this being a recognition of the fact, for instance, that, once those skilled in the art learn of a new concept in the heat treatment of metals, it is within their skill to use, for example, principles of time-temperature integration, such as set forth in U.S. Pat. No. 3,645,804 of Basil M. Ponchel, issued Feb. 29, 1972, for "Thermal Treating Control", to get the same effects at other combinations of time and temperature.

Fabricated metal is usually returned to ambient temperature by air cooling, although oil quenching may be employed after solution heat treatment steps for improving retention of metastable $\beta$-phase.

PROCESSING ROUTE 1.

With reference particularly to the processing of route 1, at least one part of the fabrication is carried out while the alloy is at temperatures in the $\beta$ phase field.

In the case of forging, preferably at least the finish forging is a $\beta$-forging. Such finish forging may be preceded by an $\alpha$-$\beta$ preform step. Alternatively, both the preform and the finish forging may be $\beta$-forging steps.

For example, the entire forging operation may be carried out at temperatures about in the range of $T_\beta + 20°$ C. to $T_\beta + 75°$ C. Alternatively, this temperature range may be used only for the finish forging, and the finish forging may be preceded by an $\alpha$-$\beta$ preform at temperatures about in the range of $T_\beta - 20°$ C. to $T_\beta - 120°$ C.

As indicated above in the section "Processing in General", $\beta$-forging steps may be of the "through-transus" type; thus, a forging step may start at a temperature in the above-mentioned range $T_\beta + 20°$ C. to $T_\beta + 75°$ C. and, by the end of the forging step, be at a temperature below the $\beta$-transus, i.e. in the $\alpha$-$\beta$ region. $\beta$-forging steps of the through-transus type are advantageous for achieving improved fracture toughness and low-cycle fatigue properties; it is thought that this effect is explainable on the microstructural level as follows: The process reduces precipitation of $\alpha$-phase at the grain boundaries, such that $\alpha$-phase there is discontinuous; to the extent that $\alpha$-phase does form, it is thin-layered as compared to the thick and continuous type of precipitates which occur, for instance, when forging is carried out entirely in the $\alpha$-phase field, coupled with slow post-forging cooling. In general, the effect is not obtained when the forging start temperature is higher, e.g. $T_\beta + 50°$ C., and clearly not at $T_\beta + 80°$ C.

$\beta$-forging may be followed by an oil quench for the purpose of reducing, or preventing, $\alpha$-phase precipitation at grain boundaries.

Fabrication is followed by solution heat treatment and then aging. Solution heat treatment is carried out at temperatures about in the range $T_\beta - 20°$ C. to $T_\beta - 120°$ C. about for a time in the range 20 to 120 minutes, for the purpose of achieving a coarse transformed beta microstructure and a near-equilibrium mixture of $\alpha$ and $\beta$ phases in the upper part of the $\alpha$-$\beta$ field of the phase diagram and a supersaturated state in the subsequent, quenched condition, preparatory to precipitation hardening in the aging step.

Aging is carried out at temperatures about in the range 425 to 650° C. (797° F. to 1202° F.) for a time in the range 2 to 25 hours, for the purpose of precipitating fine $\alpha$-phase particles in the retained supersaturated $\beta$-phase matrix. This $\beta$ matrix is then referred to as "aged".

PROCESSING ROUTE 2.

With reference particularly to the processing of route 2, fabrication is carried out while the alloy is at temperatures in the field of $\alpha$ and $\beta$ phase coexistence.

In the case of forging, a finish forging may be preceded by one or several preform steps. Both preform and finish forging steps are carried out in the $\alpha$-$\beta$ field.

Preferably, fabrication is carried out in the $\alpha$-$\beta$ field at temperatures about in the range of $T_\beta-20°$ C. to $T_\beta-120°$ C.

Fabrication is followed by solution heat treatment and then aging. Solution heat treatment is carried out at temperatures about in the range $T_\beta-5°$ C. to $T_\beta-25°$ C. about for a time in the range 20 to 80 minutes, for the purpose of achieving a near-equilibrium mixture of $\alpha$ and $\beta$ phases in the upper part of the $\alpha$-$\beta$ field of the phase diagram and a supersaturated state in the subsequent, quenched condition, preparatory to formation of transformed beta during quenching and subsequent precipitation hardening in the aging step. During the solution treatment step, a small amount of equiaxed, primary $\alpha$ is retained as equilibrium alpha-phase, while, during the cooling, or quenching, step, part of the $\beta$-phase transforms to acicular to plate-type, or basket-weave, secondary $\alpha$.

Solution heat treatment may include a stage subsequent to the treatment in the range $T_\beta-5°$ C. to $T_\beta-25°$ C. This subsequent stage is carried at temperatures lower in the $\alpha$-$\beta$ field, for instance at temperatures about in the range $T_\beta-40°$ C. to $T_\beta-120°$ C. about for a time in the range 1 to 3 hours, for the purpose of thickening the transformed $\beta$ (secondary $\alpha$).

As in process route 1, aging is carried out at temperatures about in the range 425° to 650° C. (797° F. to 1202° F.) for a time in the range 2 to 25 hours, for the purpose of precipitating fine $\alpha$-phase particles in retained $\beta$-phase matrix.

The following examples will serve to illustrate the invention.

EXAMPLES

Table I provides composition information for the particular Ti-6Al-2Sn-4Zr-6Mo alloys tested. The "max" and "min" values show the compositional ranges to exist among the particular alloys.

Table II reports the thermomechanical processing histories and the microstructures obtained. Resulting mechanical properties are reported in Table III.

All of the examples started with $\alpha$-$\beta$ fabricated and $\alpha$-$\beta$ annealed bar stock. 15.24 cm (6-inch) diameter by 14.2 cm (5.6-inch) to 31 cm (12.2-inch) long bar stock samples were hot die forged in the case of examples 1 to 4 (die temperature in the range 1300° to 1600° F., 700° to 875° C.) at a crosshead speed of 51 cm (20 inches) per minute to produce forged dimensions as given in Table II. The 14.2 cm (5.6-inch) length material was used to make pancake forgings measuring 25.4 cm (10.0 inches) diameter by 6.35 cm (2.0 inches) thick, while the 31 cm (12.2-inch) length was fabricated into pancake forgings measuring 22.9 cm (9.0 inches) diameter by 13.7 cm (5.4 inches) thick. Example 5 was warm die forged under the conditions shown in Table II.

From the data reported in Table III, it can be seen that the alloys of the invention have excellent tensile properties and fracture toughness. Particularly effective are Examples 2 and 4. Table IV reports on fatigue properties, namely low cycle fatigue and fatigue crack growth rate.

While the invention has been illustrated by numerous examples, obvious variations may occur to one of ordinary skill and thus the invention is intended to be limited only by the appended claims.

TABLE I

Chemical Analysis* of Ti—6Al—2Sn—4Zr—6Mo Billet Stocks

| | C | N | Fe | Al | Sn | Zr | Mo | O | H |
|---|---|---|---|---|---|---|---|---|---|
| Maximum | .01 | .01 | .06 | 6.0 | 2.1 | 4.3 | 6.0 | .09 | 50 ppm |
| Minimum | .012 | .008 | .09 | 5.7 | 2.0 | 3.8 | 5.6 | .12 | 35 ppm |

*Values are in %, unless indicated otherwise.

TABLE II

THERMOMECHANICAL PROCESSING HISTORIES AND MICROSTRUCTURES OF THE 25.4 CM DIAMETER × 6.35 cm THICK AND 22.9 CM DIAMETER × 13.7 CM THICK PANCAKE FORGINGS

Figure 1B:
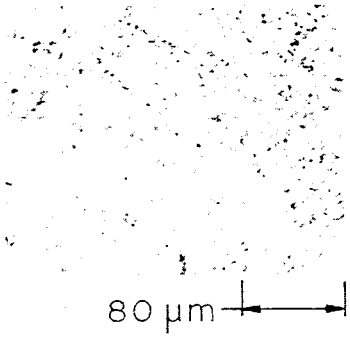
Figure 1C:
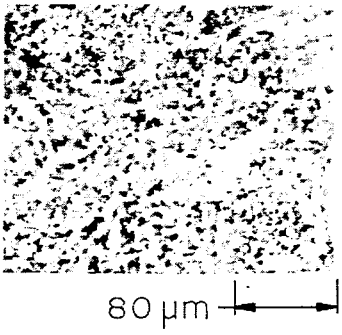
Figure 4A:
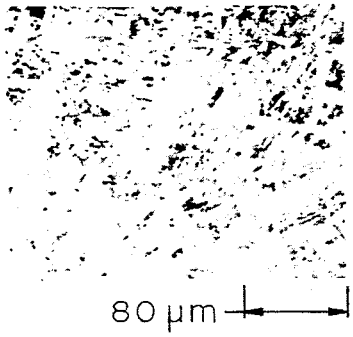
FIGS. 4A, 4B and 4C show microstructure, respectively, at center, mid-radius, and rim, all at mid-height, in a 25.4 cm diameter by 6.35 cm thick pancake forging.
Figure 4B:
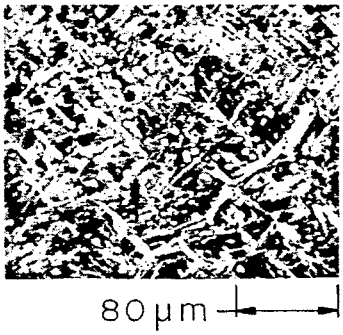
Figure 4C:
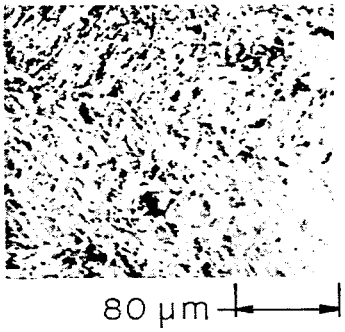

| Example No. | Forged Dimension | Forging History | Heat Treatments | Microstructural Observations |
|---|---|---|---|---|
| 1 | 25.4 cm dia. × 6.35 cm (10.0" dia. × 2.5") | Alpha-Beta Preform ($T_\beta$ − 42° C.) Alpha-Beta Finish ($T_\beta$ − 42° C.) | $T_\beta$ − 8° C./1 hr, OQ + $T_\beta$ − 97° C./2 hr, AC + 593° C./8 hr, AC | 5–10% fine primary equiaxed alpha and fine to coarse acicular secondary alpha (50–70%) in an aged beta matrix. (FIG. 1B or 1A) |
| 2 | 25.4 cm dia. × 6.35 cm (10.0" dia. × 2.5") | Alpha-Beta Preform ($T_\beta$ − 42° C.) Beta Finish ($T_\beta$ + 42° C.) | $T_\beta$ − 42° C./1 hr, AC + 593° C./8 hr, AC | Coarse acicular to plate type secondary alpha (50–80%) in an aged beta matrix with semicontinuous grain boundary alpha. (FIG. 2B) |
| 3 | 25.4 cm dia. × 6.35 cm (10.0" dia. × 2.5") | Alpha-Beta Preform ($T_\beta$ − 42° C.) Alpha-Beta Finish ($T\beta$ − 42° C.) | $T_\beta$ − 6° C./1 hr, AC + 593° C./8 hr, AC | 10% fine equiaxed primary alpha in a basket-weave type secondary alpha (50–80%) in an aged beta matrix with discontinuous grain boundary alpha. (FIG. 4B) |
| 4 | 22.9 cm dia. × 13.7 cm (9.0" dia. × 5.4") | Beta Forged at $T_\beta$ − 42° C., die at 815° C. ± 13° C., OQ | $T_\beta$ − 42° C./2 hr, FAC + 593° C./8 hr, AC | Plate type transformed beta in aged beta matrix with discontinuous grain boundary alpha (FIG. 3) |
| 5 | 22.9 cm dia. × 13.7 cm | Beta Forged at $T_\beta$ − 42° C., | $T_\beta$ − 42° C./2 hr, FAC + 593° C./8 hr, AC | Plate type transformed beta in aged beta matrix with discontinuous grain |

TABLE II-continued

THERMOMECHANICAL PROCESSING HISTORIES AND MICROSTRUCTURES OF THE 25.4 CM DIAMETER × 6.35 cm THICK AND 22.9 CM DIAMETER × 13.7 CM THICK PANCAKE FORGINGS

| Example No. | Forged Dimension | Forging History | Heat Treatments | Microstructural Observations |
|---|---|---|---|---|
| | (9.0" dia. × 5.4") | die at 300° C. ± 25° C., AC | | boundary alpha. |

FAC = fan air cool, OQ = oil quench, AC = air cool

TABLE III

Mechanical Properties of the 25.4 cm Diameter × 6.35 cm Thick and 22.9 cm Diameter × 13.7 cm Thick Pancake Forgings Tensile Properties

| Example No. | YS ksi (MPa) | UTS ksi (MPa) | % El | % RA | Fracture Toughness $K_{Ic}$ ksi · in$^{\frac{1}{2}}$ (MPa · m$^{\frac{1}{2}}$) |
|---|---|---|---|---|---|
| 1 | 153.0 (1054.8) | 183.0 (1261.6) | 7.0 | 10.3 | 46.6 (51.1) |
| 2 | 155.5 (1072.0) | 169.4 (1183.0) | 11.5 | 16.0 | 67.2 (73.8) |
| 3 | 158.0 (1089.2) | 166.8 (1149.9) | 11.0 | 20.6 | 52.7 (57.8) |
| 4 | 144.0 (993) | 163.0 (1124) | 11.5 | 22.1 | 67.9 (74.5) |
| 5 | 150.53 (1038) | 166.34 (1147) | 9.8 | 23.6 | |

YS = yield strength, UTS = ultimate tensile strength, El = elongation, and RA = reduction in area. The alloys were tested by ASTM E 8-83 (room temperature tension tests) and ASTM 399-83 (fracture toughness test).

TABLE IV

Strain Controlled Fatigue Properties of the 25.4 cm Diameter × 6.35 cm Thick and 22.9 cm Diameter × 13.7 cm Thick Pancake Forgings

| Example No. | Low Cycle Fatigue*, Cycles to Failure | Fatigue Crack Growth Rate**, Inches per Cycle | (Meters per Cycle) |
|---|---|---|---|
| 1 | 23,000 | $1.2 \times 10^{-6}$ | $(3.0 \times 10^{-8})$ |
| 2 | 14,000 | $1 \times 10^{-6}$ | $(2.5 \times 10^{-8})$ |
| 3 | 20,000 | $5 \times 10^{-7}$ | $(1.3 \times 10^{-8})$ |

*Testing according to ASTM E 606-80, strain control with extensometry at a total strain range of 1.0%, wave form triangular at 20 CPM, Kt = 1.0, i.e., notch factor equal to zero (smooth bar specimen, 0.25 in. (0.635 cm) diameter gauge section), and at "A"-ratio = 1.0, where A = (1 − R)/(1 + R), with R, the ratio of minimum strain to maximum strain, being equal to zero.

**Testing according to ASTM E 647-81, at WK = 10 ksi · in$^{\frac{1}{2}}$ (11 MPa · m$^{\frac{1}{2}}$).

Figure 2A:
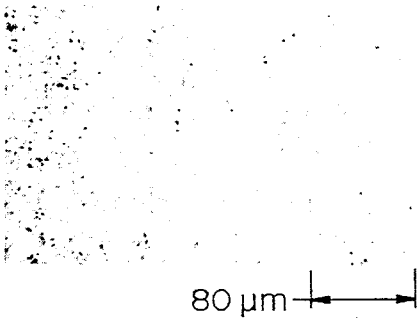
FIGS. 2A and 2B are both at the mid-height, mid radius location, one being at twice the magnification of the other, in a 25.4 cm diameter by 6.35 cm thick pancake forging.
Figure 2B:
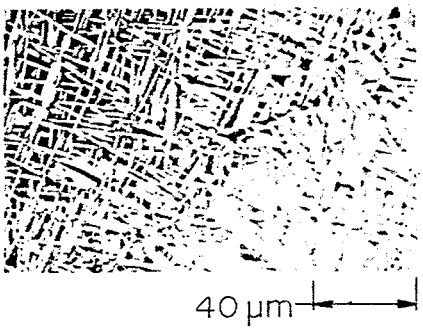
Figure 3:
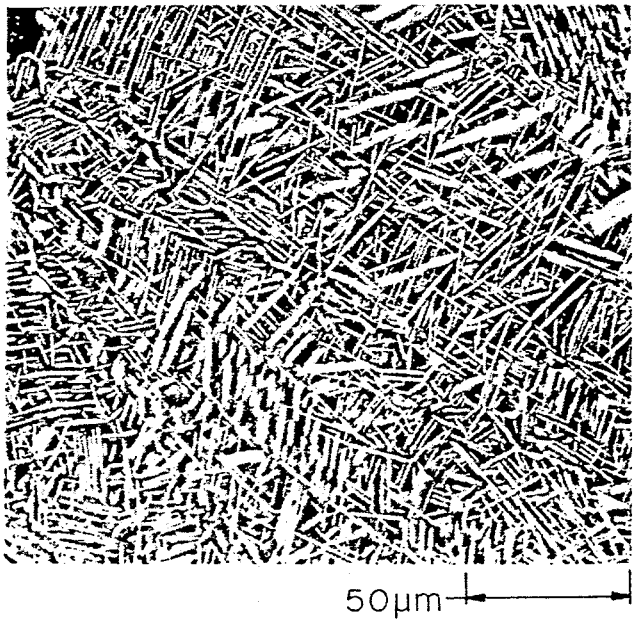
FIG. 3 is taken at the mid-height, mid radius location in a 22.9 cm diameter by 13.7 cm thick pancake forging.

What is claimed is:

1. A method of processing titanium alpha-beta alloy, comprising finish $\beta$-fabricating without significant recrystallization, $\alpha$-$\beta$solution heat treating, and aging, having in the alloy a microstructure of coarse and fine, acicular to plate-type secondary alpha (about 60–80%) in an aged beta matrix (FIGS. 2 and 3).

2. A method as claimed in claim 1 wherein the fabricating comprises forging and at least finish forging is a $\beta$-forging.

3. A method as claimed in claim 1 wherein solution heat treating is carried out at temperatures about in the range $T_\beta-20°$ C. to $T_\beta-120°$ C. about for a time in the range 20 to 120 minutes, the purpose of achieving a coarse transformed beta microstructure and a near-equilibrium mixture of $\alpha$ and $\beta$ phases in the upper part of the $\alpha$-$\beta$ field of the phase diagram and a supersaturated state in the subsequent, quenched condition, preparatory to precipitation hardening in the aging step.

4. A method as claimed in claim 1 wherein aging is carried out at temperatures about in the range 425° to 650° C. for a time in the range 2 to 25 hours, for the purpose of precipitating fine $\alpha$-phase particles in retained $\beta$-phase matrix.

5. A method as claimed in claim 1 wherein the alloy is Ti-6Al-2Sn-4Zr-6Mo.

6. A method as claimed in claim 2 wherein the $\beta$-forging is a through-transus type $\beta$-forging.

7. A method as claimed in claim 2 wherein finish forging is preceded by an $\alpha$-$\beta$ preform step.

8. A method as claimed in claim 2 wherein finish forging operation is preceded by a preform step in the $\beta$ phase field.

9. A method as claimed in claim 2 wherein the $\beta$-forging is started at temperatures about in the range of $T_\beta+20°$ C. to $T_\beta+75°$ C.

10. A method as claimed in claim 2 wherein $\beta$-forging is followed by an oil quench for reducing $\alpha$-phase precipitation at grain boundaries.

11. A method as claimed in claim 2 wherein forging is hot die forging.

12. A method as claimed in claim 2 wherein forging is warm die forging.

13. A method as claimed in claim 8 wherein the preform step is a through-transus type $\beta$-forging step.

14. A method as claimed in claim 9 wherein finish forging is carried out at temperatures about in the range of $T_\beta+20°$ C. to $T_\beta+75°$ C. and preceded by an $\alpha$-$\beta$preform at temperature about in the range of $T_\beta-20°$ C. to $T_\beta-120°$ C.

15. A method as claimed in claim 9 wherein the entire forging operation is done in the $\beta$ phase field about at $T_\beta 42°$ C., followed by an oil quench, followed by solution heat treating at about $T_\beta-42°$ C. for about 2 hours and aging at about 593° C. for about 8 hours.

16. A method as claimed in claim 14 wherein the preform is carried out at $T_\beta-42°$ C. and the finish about at $T_\beta+42°$ C., followed by solution heat treating at about $T_\beta-42°$ C. for about 1 hour and aging at about 593° C. for about 8 hours.

17. A method of processing titanium alpha-beta alloy, comprising $\alpha$-$\beta$-fabricating, $\alpha$-$\beta$ solution heat treating at temperatures about in the range $T_\beta-5°$ C. to $T_\beta-25°$ C., and aging.

18. A method as claimed in claim 17 wherein the fabricating comprises forging.

19. A method as claimed in claim 17 wherein solution heat treating is carried out at temperatures about in the range $T_\beta-5°$ C. to $T_\beta-25°$ C. about for a time in the range 20 to 80 minutes, for the purpose of achieving a near-equilibrium mixture of $\alpha$ and $\beta$ phases in the upper part of the $\alpha$-$\beta$ field of the phase diagram and a supersaturated state in the subsequent, quenched condition, preparatory to formation of transformed beta during quenching and subsequent precipitation hardening in the aging step.

20. A method as claimed in claim 17 wherein aging is carried out at temperatures about in the range 500° to 650° C. for a time in the range 2 to 25 hours, for the purpose of precipitating fine $\alpha$-phase particles in retained $\beta$-phase matrix.

21. A method as claimed in claim 17 wherein the alloy is Ti-6Al-2Sn-4Zr-6Mo.

22. A method as claimed in claim 18 wherein the forging comprises a finish forging preceded by one or several preform steps, both preform and finish forging steps being carried out in the $\alpha$-$\beta$ field.

23. A method as claimed in claim 18 wherein forging is hot die forging.

24. A method as claimed in claim 18 wherein forging is warm die forging.

25. A method as claimed in claim 19 wherein forging is carried out at temperatures about in the range of $T_\beta-20°$ C. to $T_\beta-120°$ C.

26. A method as claimed in claim 19 wherein solution heat treating includes a stage subsequent to the treatment in the range $T_\beta-5°$ C. to $T_\beta-25°$ C., said subsequent stage being carried at temperatures lower in the $\alpha$-$\beta$ field for the purpose of thickening transformed $\beta$ (secondary $\alpha$).

27. A method as claimed in claim 25 wherein the preform and finishing steps are done in the $\alpha$-$\beta$ field at $T_\beta-42°$ C., followed by solution heat treating first at about $T_\beta-8°$ C. for about 1 hour then at about $T_\beta-97°$ C. for about 2 hours, followed by aging at about 593° C. for about 8 hours.

28. A method as claimed in claim 25 wherein the preform and finishing steps are done in the $\alpha$-$\beta$ field at $T_\beta-42°$ C., followed by solution heat treating at about $T_\beta-6°$ C. for about 1 hour, followed by aging at about 593° C. for about 8 hours.

29. A method as claimed in claim 26, said lower temperatures being about in the range $T_\beta-40°$ C. to $T_\beta-120°$ C., the time of treatment at said lower temperatures being about in the range 1 to 3 hours.

* * * * *

UNITED STATES PATENT AND TRADEMARK OFFICE

CERTIFICATE OF CORRECTION

PATENT NO. : 5,173,134

DATED : December 22, 1992

INVENTOR(S) : Amiya K. Chakrabarti, George W. Kuhlman Jr., and Robert Pishko

It is certified that error appears in the above-identified patent and that said Letters Patent is hereby corrected as shown below:

| | |
|---|---|
| **On the title page:Item [75]:** | Chakrabarti is of Pennsylvania, Kuhlman is of Ohio, and Pishko is of Pennsylvania (not all of Pennsylvania) |
| Claim 3, Column 7, line 60 | Add "for" after "minutes,". |
| Claim 16, Column 8, line 46 | Change "out" to --about--. |

Signed and Sealed this

Second Day of November, 1993

*Attest:*

*Attesting Officer*

Bruce Lehman

BRUCE LEHMAN

*Commissioner of Patents and Trademarks*